United States Patent [19]

Miyamoto et al.

[11] 4,175,373

[45] Nov. 27, 1979

[54] DIGITAL CLOCK

[75] Inventors: Kazuo Miyamoto, Showa; Isao Suzuki, Tochigi; Hideo Koide, Urawa, all of Japan

[73] Assignee: Rhythm Watch Company Limited, Tokyo, Japan

[21] Appl. No.: 865,937

[22] Filed: Dec. 30, 1977

[30] Foreign Application Priority Data

Aug. 16, 1977 [JP] Japan ..... 52/98503

[51] Int. Cl.[2] ..... G04B 23/00; G04C 21/16; G04B 19/02

[52] U.S. Cl. ..... 58/16 D; 58/125 C; 40/119

[58] Field of Search ..... 58/7, 16, 16 D, 19 R, 58/21.1, 125 R, 125 C, 126 R, 126 E; 235/103, 104, 95, 96, 115, 117, 119, 133, 139; 40/111, 119, 573, 575; 74/436

[56] References Cited

U.S. PATENT DOCUMENTS

| | | | |
|---|---|---|---|
| 2,040,421 | 5/1936 | Almquist | 58/125 C |
| 2,073,275 | 3/1937 | Elberg | 40/111 |
| 2,636,339 | 4/1953 | Holzner | 58/125 C |
| 2,645,896 | 7/1953 | Uhlig et al. | 58/125 C |
| 3,065,929 | 11/1962 | Herr | 235/139 R |
| 3,224,673 | 12/1965 | Leonard | 235/117 R |
| 3,807,167 | 4/1974 | Chapatte | 58/125 C |
| 4,005,570 | 2/1977 | Miyamoto et al. | 58/16 D |
| 4,098,069 | 7/1978 | Kobayashi | 58/21.11 |

*Primary Examiner*—Vit W. Miska

*Attorney, Agent, or Firm*—Koda and Androlia

[57] ABSTRACT

A digital display clock including a one-minute indicating wheel, a ten-minute indicating wheel and an hour indicating wheel which are driven by intermittent and segmental rotations through separately provided Geneva-gear mechanisms for each individual indicating section, a driving system arranged in the back of digital clock, so that the clock is able to provide a wide and effective display area in front of the clock and an excellent design for a 24 hour display digital clock with diversity.

10 Claims, 7 Drawing Figures

DIGITAL CLOCK

BACKGROUND OF THE INVENTION

1. Field of the Invention

This invention relates to a digital display clock and in particular to the digital type clock in which the time is displayed on a plurality of tilting leaf plates or on the cylindrical surface of drums which is driven with uniform rotation transmitted from a means for generating time signals.

2. Prior Art

It has been well-known that there have been various digital display clocks in which an oscillator is used as the means for generating time signals, or in which a plurality of tilting leaf plates with printed time figures thereon or the cylindrical surface of the drums with printed time figures thereon is driven by AC synchronous motor as the means for generating time signals. In a conventional digital clock uniform rotation of the driving section is changed into an intermittent and segmental rotation corresponding to each time indication by means of a so-called Geneva-gear mechanism so that the number of displaying leaves for each indicating division can be reduced. In a normal digital display clock, the Geneva-gear mechanim is palced between indicating sections, for example, between a minute wheel and a hour wheel. Consequently, in the prior art system the display area in the front is reduced and the space between one-minute, ten-minute and hour indicating leaves is widened in comparison with the total body size of digital clock because of use of the Geneva-gear mechanism. Such limitations cause an affect upon the display and provides some restrictions in the design. There is another drawback in the composition of indicating sections since the reduction ratio of Geneva-gear mechanism cannot be designed very small in the prior art system; that is the normal Geneva-gear can only provide a ratio of 12 to 1 at the least. In the prior art system, the minute indicating leaves cannot be divided into one-minute indications and ten-minute indications, which must have a small reduction gear ratio, and such a means is adopted that 60 leaves must be mounted on single minute indicating wheel at the least and that one leaf must be moved every one minute. If the cylindrical drum system is adopted, the minute indication is driven by a uniform rotation instead of an intermittent segmental motion and the hour indication is only driven by an intermittent rotation. Such a prior art system suffers from several defects. Processing and assembling of such system is complicated and expensive due to the comparative increase in the number of leaves in the leaf type of digital clock. The display is hard to be read due to the fact that the figures are fairly small printed on the cylindrical surface of drum in the drum type digital clock. Furthermore, the prior art system in which the reduction ratio of Geneva-gear mechanism which restricts the design of a 24 hour display clock is fatally disadvantageous in alarm system, timer, kitchen timer, etc.

The above-described drawbacks are caused by employment of individual time indicating wheels themselves as a part of the Geneva-gear mechanism which is used as the intermittent reducing transmission mechanism among individual time indicating wheels, which affects and retricts display area and reduction gear ratio.

SUMMARY OF THE INVENTION

Accordingly, it is the general object of the present invention to provide a digital display clock with a new composition which makes it possible to furnish a wide display area so that the display is easily read.

In keeping with the principles of the present invention, the object is accomplished with a unique digital display clock in which each Geneva-gear mechanism of an intermittent transmission system is separately provided for each time indicating section and in which various design limitations of prior art time indicating section are removed.

BRIEF DESCRIPTION OF THE DRAWINGS

The above mentioned and other features and objects of the present invention will become more apparent by reference to the following description taken in conjunction with the accompanying drawings, wherein like referenced numerals denote like elements, and in which.

DETAILED DESCRIPTION OF THE INVENTION

Figure 1:
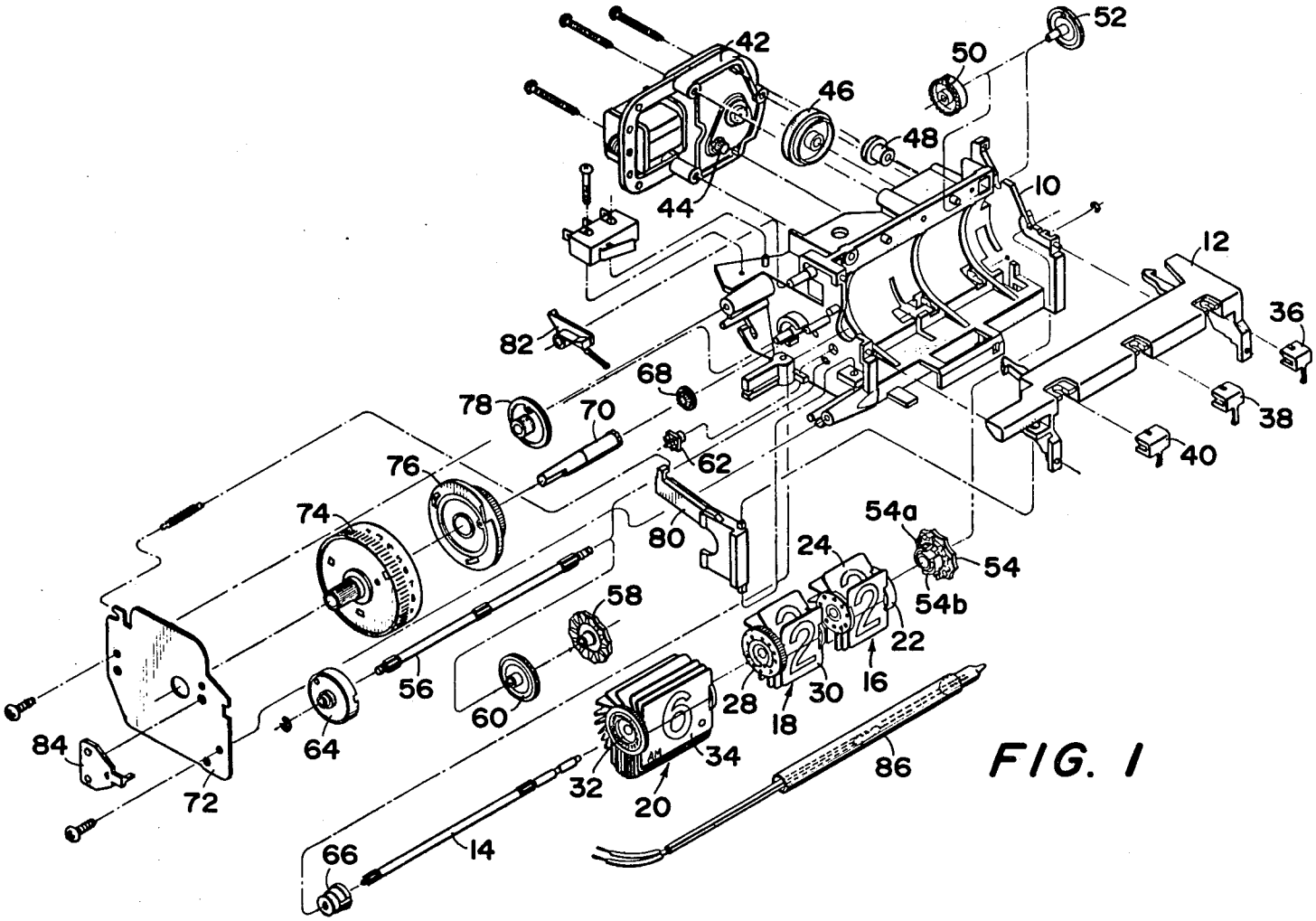
FIG. 1 is an exploded perspective view illustrating a preferred embodiment of a digital type clock in accordance with the teachings of the present invention.
Figures 2, 3:
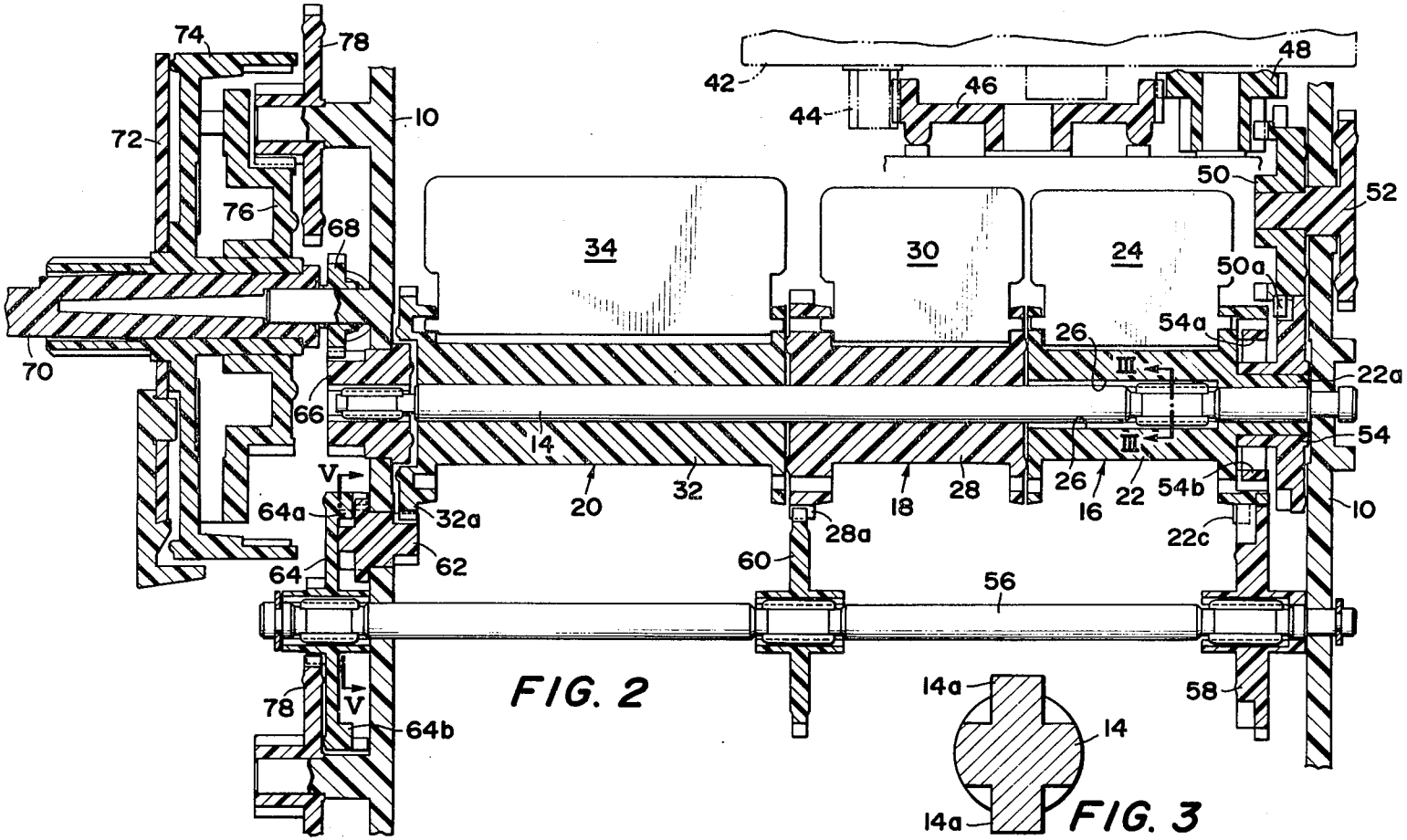
FIG. 2 is a cross-sectional view of a driving mechanism illustrating a main section of FIG. 1.
FIG. 3 is a cross-sectional view taken on line III—III of FIG. 2 which show a section of indicating wheel shaft 14.

Referring more particularly to the drawings, shown in FIG. 1 is an exploded perspective view illustrating a preferred embodiment of a digital display clock in accordance with the teachings of the present invention and shown in FIG. 2 is a cross-sectional view of a drive transmission system of FIG. 1 shown in detail.

Between the main frame 10 and the detachable frame 12 an indicating wheel shaft 14 is loosely mounted so as to smoothly rotate. The main frame 10 and the deteachable frame 12 are made of plastics, and are detachable at both pillows of indicating wheel shaft 14. Elastic action of plastic makes it very easy to have the frames 10 and 12 taken apart and put back without the use of tightening means such as screws, for access to wheel shaft 14. The illustrated embodiment shows the leaf type digital clock. The one-minute indicating wheel 16 is mounted on the indicating wheel shaft 14 in order to be rotated therewith, and the ten-minute indicating wheel 18 and the hour indicating wheel 20 are loosely supported on the shaft 14 in order to be easily rotated. The one-minute indicating wheel 16 carries figures from "0" to "9" on the periphery of its spool 22 by means of ten sheets of one-minute indicating leaves 24 which are loosely hinged with equal space and are capable of swinging and moving. Two grooves 26 provided in a center hole of the wheel 16 engage with key section 14*a* and one-minute indicating wheel 16 rotates together with indicating wheel shaft 14. Ten-minute indicating wheel carries two units of figures from "0" to "5" on the periphery of spool 28 by means of 12 sheets of ten-minute indicating leaves 30 which are loosely hinged with the capability of swinging and moving. In the same way an hour indicating wheel 20 carries figures "AM 1" to "AM 12" and "PM 1" to "PM 12" on the peripheries of spool 32 by means of 24 sheets of hour indicating leaves 34 which are loosely hinged with the capability of swinging and moving. The previously described display composes a 24 hour displaying digital type clock. The respective leaf units of 24, 30 and 34 are guided into their operational situation by the rubber leaf checks 36, 38 and 40 which are capable of being taken apart from and being inserted back into the front of detachable frame 12.

In the illustrated embodiment an AC synchronous motor is used as a means for generating time signals and the motor 42 is fixed on the backside of main frame 10 by screws. The uniform rotation driving power of the motor driving section is transmitted through a motor pinion 44 to a median wheel 46 mounted on the main frame 10, a third wheel 48, and a second wheel 50. The second wheel 50 carries a crown gear and is firmly fixed to a movement transmission wheel 52 which transmits rotation to second indicating wheel, which is not shown.

Figure 4A:
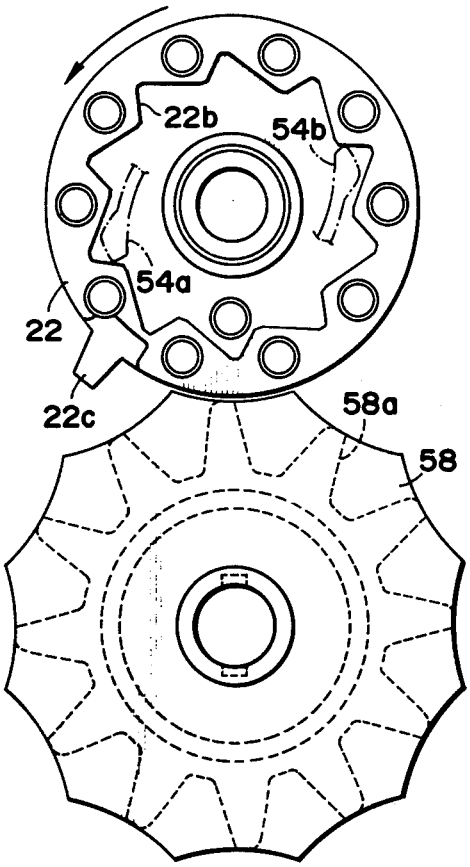
FIG. 4*a* and FIG. 4*b* are operational illustrations of the second Geneva-gear mechanism in FIG. 2.

The uniform rotation of second wheel 50 is transmitted to the one-minute indicating wheel 16 through a first Geneva-gear mechanism with intermittent driving power at intervals of one minute. The first Geneva-gear mechanism includes a Geneva-gear 54, which is loosely mounted on the sleeve 22*a* provided on the side end of spool 22 of one-minute indicating wheel 16 and which is intermittently driven by the ratchet 50*a* secured to the periphery of second wheel 50. The rotation of Geneva-gear 54 is transmitted to the one-minute indicating wheel 16 through a clutch mechanism which is composed of elastic ratchet 54*a* and 54*b* solidly fixed to Geneva-gear 54 and inside teeth 22*b* secured in the side end of spool 22 as shown in FIG. 2 and FIG. 4*a*. As described in the above, the uniform rotation driving power of motor 42 is transmitted to the one-minute indicating wheel 16 as intermittent rotation at intervals of one minute, which is further transmitted to the indicating wheel shaft 14 through the spool 22. The clutch mechanism secured between Geneva-gear 54 and spool 22 prevents the rotation of spool 22 from being transmitted to Geneva-gear 54 during the correction of indicating time.

The rotation of one-minute indicating wheel 16 is transmitted to respective indicating wheels 18 and 20 through a second and a third Geneva-gear mechanism described hereinbelow. The present invention is characterized by a transmission which is not provided on the respective indicating wheels but which is a separately provided transmission system.

Figure 4B:
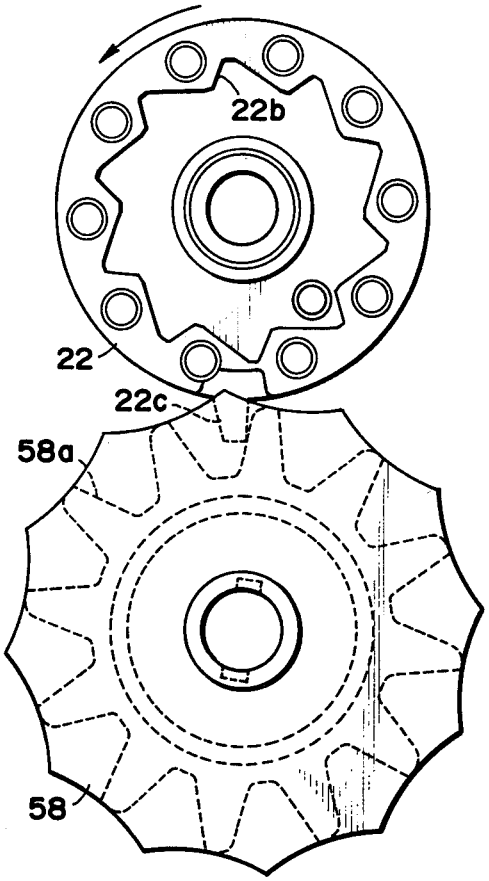

The intermittent transmission mechanism in the embodiment of the present invention includes driving shaft 56 which is loosely mounted on the main frame 10 and the detachable frame 12 in order to be easily rotated, and to which the second and the third Geneva-gear mechanism are coupled. The second Geneva-gear mechanism includes Geneva-gear 58 which is mounted on driving wheel 56 in order to be turned together therewith and which is intermittently driven by the ratchet 22*b* secured on the periphery of spool 22 of one-minute interval wheel 16. The Geneva-gear 58 carries 12 tooth gear 58*a* on it which corresponds to 12 sheets of indicating leaves 30 hinged on the ten-minute indicating wheel 18 and intermittently turns the driving shaft 56 one pitch when the tooth 22*c* engages with the gear 58 as the spool 22 is intermittently driven into the state of FIG. 4*b* from the state of FIG. 4*a*. As described above, the intermittent rotation of one-minute interval wheel 16 is transmitted to driving shaft 56 for intermittent driving power at intervals of ten minutes. On the driving shaft 56 is further mounted a conducting wheel 60 so as to be turned together with and the engagement of conducting wheel 60 with a gear part 28*a* which is secured on the spool 28 of ten-minute indicating wheel 18 and which conveys the intermittent driving power to the ten-minute indicating wheel 18 at intervals of ten minutes.

As per the above, the one-minute indicating wheel 16 and the ten-minute indicating wheel 18 are each provided with rotation through a driving system separately provided from the indicating wheels, and it is possible to easily read the one-minute and ten-minute displays since between both indicating wheels 16 and 18 is not provided a transmission mechanism and the spools 22 and 28 and the indicating leaves 24 and 30 can be mounted at extremely close space.

Figure 5A:
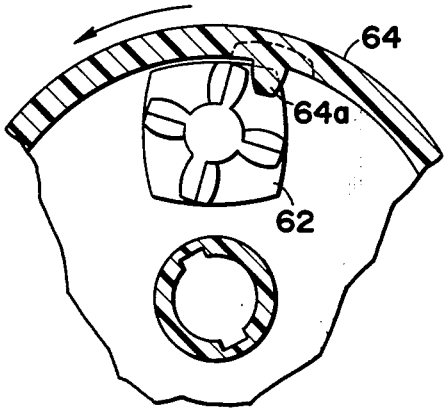
FIG. 5*a* and FIG. 5*b* are operational illustrations of the third Geneva-gear mechanism of the present invention.
Figure 5B:
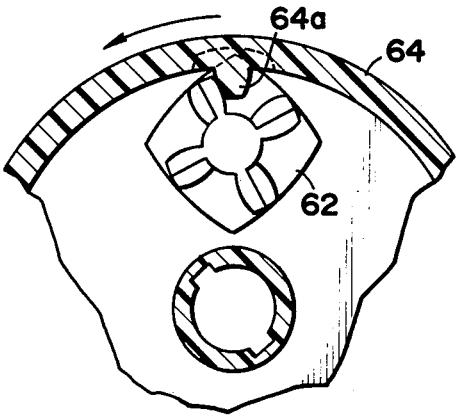

The third Geneva-gear mechanism which transmits the intermittent driving power to a hour indicating wheel 20 is composed of an inner tooth Geneva-gear mechanism whereas the afore-described first and second Geneva-gear mechanism consists of an outer tooth Geneva-gear mechanism. The third Geneva-gear mechanism includes a Geneva-gear 62 which is loosely mounted on the main frame 10 and a Geneva-gear generative wheel 64 which is fixed to the driving shaft 56 so as to be turned together therewith. As shown in FIG. 5*a* and 5*b* in detail, two ratchets 64*a* and 64*b* secured on the generative wheel 64 engage with four corresponding teeth of Geneva-gear 62, and the Geneva-gear 62 is intermittently driven at intervals of one hour. As mentioned in the above, the Geneva-gear 62 driven intermittently engages with a gear part 32*a* secured on the spool 32 of hour indicating wheel 30 and transmits intermittent driving power to hour indicating wheel 20 at intervals of one hour.

On the one end of indicating wheel shaft 14 is mounted a conducting wheel 66 so as to be turned together therewith. Through the ratchet 68 the shaft 14 is coupled to correcting shaft 70, one way rotation of which is able to correct the indications of each indicating wheels 16, 18 and 20.

Furthermore, in the illustrated embodiment there is provided an alarm mechanism between the main frame 10 and an alarm mechanism holding plate 72. The alarm mechanism includes alarm setting dial 74. Inside of alarm setting dial 74, a setting disc 76 is loosely mounted on the correcting shaft 70 so as to be easily rotated and the rotation of driving shaft is transmitted to the setting disc 76 through the gear 78. The setting disc 76 and the alarm setting dial 74 comprises a well-known telescopic cam mechanism and joining of indicating time with a certain predetermined time telescopes the setting disc 76 towards left direction in FIG. 2. The telescopic movement of setting disc 76 in the direction of the shaft results in rocking movement of a rocker arm 80, which results in operation of well-known alarm means or time switch means which is not shown in the Figures.

In the Figure, pawl 82 prevents the alarm setting dial 74 from reverse rotation, pointer 84 indicates the alarm setting and illumination lamp 86 illuminates the display.

As is evident from the above description, the present invention provides a time indicating section which utilizes the whole front displayable area of digital clock since the uniform rotation driving power of motor 42 is transmitted to a separately provided transmission system from the respective indicating wheels 16, 18 and 20, and can provide indications which are very easy to read. Furthermore, the arrangement of driving system in the backside of digital clock can provide an effective usage of the front section of the clock for the time indicating section and alarm setting section, and can provide an excellent digital display clock having diversity in indicating action and design.

Additionally, the illustrated embodiment is shown for the leaf type digital clock but the cylindrical drum type digital clock can be easily created by changing the indicating wheels into the indicating drums. The alteration of transmission ratio between the Geneva-gear 62 in the third Geneva-gear mechanism and the gear part 32 of hour indicating wheel 20 can easily provide a 12 hour display digital clock. In the illustrated embodiment, since the Geneva-gear 62 and the gear part 32*a* consists of reducing means, the rotating angle of Geneva-gear 62 is increased so as to secure the reliable operation of Geneva-gear mechanism, which is able to compose a preferred 24 hour display. Furthermore, since the third Geneva-gear mechanism in the illustrated embodiment adopts the inner tooth Geneva-gear mechanism, the rotation of driving shaft 56 and hour indicating wheel 20 can be directed toward the same way, which provides a Geneva-gear mechanisms preferred for means for transmitting the driving power through single driving shaft 56 to two kinds of indicating wheels, that is, minute indicating wheel 18 and hour indicating wheel 20.

As described hereinabove, the present invention provides an effective digital display clock easily readable with a simple and diversified design.

In all cases, it is understood that the above described embodiments are merely illustrative of but a few of many possible specific embodiments which represent the applications of the principles of the present invention. Numerous and varied other arrangements can be readily devised in accordance with these principles by those skilled in the art without departing from the spirit and scope of the invention.

We claim:

1. A digital display clock comprising:

a driving section including a means for generating time signals which produce rotating driving power;

an indicating display including a one-minute indicating wheel, a ten-minute indicating wheel, and an hour indicating wheel which receive rotation driving power from said driving section and which are mounted on an indicating wheel shaft to be driven intermittently, said one-minute indicating wheel, said ten-minute indicating wheel and said hour indicating wheel being mounted on an indicating wheel shaft;

a (frist) first Geneva-gear mechanism which transmits the rotation driving power through said driving section for an intermittent driving power at intervals of one minute to said indicating wheel shaft, and, one-minute indicating wheel rotating with said indicating wheel shaft;

a driving shaft (separately secured from) laterally mounted with respect to said indicating wheel shaft, a single gear on said driving shaft, (and simultaneously rotated with) said ten-minute indicating wheel being freely rotatable on said indicating wheel shaft and being engaged by said gear for rotation;

a second Geneva-gear mechanism (which transmits the intermittent rotation of) connected to said one-minute indicating wheel and to said driving shaft (and) to transmit intermittent motion to said ten-minute indicating wheel through said gear as an intermittent driving power at intervals of ten minutes; and a third Geneva-gear mechanism (which transmits the intermittent rotation of) connected between said driving shaft (to) and said hour indicating wheel for an intermittent driving power to said hour indicating wheel at intervals of one hour, each of said Geneva-gear mechanisms being positioned at the ends of said driving shaft and only said single gear being positioned intermediate the ends of said indicating display so that said indicating display is substantially uninterrupted by lateral spacing.

2. A digital display clock according to claim 1 wherein said hour indicating wheel displays twenty-four hours.

3. A digital display clock according to claim 2 wherein between said third Geneva-gear mechanism and said hour indicating wheel is provided a reducing means.

4. A digital display clock according to claim 1 wherein said third Geneva-gear mechanism consists of an inner tooth Geneva-gear mechanism.

5. A digital display clock according to claim 2 wherein said third Geneva-gear mechanism consists of an inner tooth Geneva-gear mechanism.

6. A digital display clock according to claim 3 wherein said third Geneva-gear mechanism consists of an inner tooth Geneva-gear mechanism.

7. A digital display clock according to claim 1 wherein said one-minute indicating wheel, said ten-minute indicating wheel and said hour indicating wheel are provided with leaves loosely hinged to said wheels for indicating the time.

8. A digital display clock according to claim 1 further comprising an alarm mechanism.

9. A digital display clock according to claim 1 wherein said driving section comprises an AC synchronous motor.

10. A digital display clock according to claim 8 further comprising a means for correcting the time displayed on said indicating display and a means for setting an alarm time for said alarm mechanism.

* * * * *